US010801782B2

(12) United States Patent
Petersen et al.

(10) Patent No.: US 10,801,782 B2
(45) Date of Patent: Oct. 13, 2020

(54) HEAT EXCHANGER UNIT AND THERMOTECHNICAL SYSTEM

(75) Inventors: Stefan Petersen, Berlin (DE); Christian Finck, Amsterdam (NL); Martin Mittermaier, Berlin (DE); Anna Jahnke, Berlin (DE)

(73) Assignee: TECHNISCHE UNIVERSITÄT BERLIN, Berlin (DE)

( * ) Notice: Subject to any disclaimer, the term of this patent is extended or adjusted under 35 U.S.C. 154(b) by 772 days.

(21) Appl. No.: 13/257,929

(22) PCT Filed: Mar. 19, 2010

(86) PCT No.: PCT/DE2010/000309

§ 371 (c)(1), (2), (4) Date: Dec. 6, 2011

(87) PCT Pub. No.: WO2010/105613

PCT Pub. Date: Sep. 23, 2010

(65) Prior Publication Data

US 2012/0067713 A1 Mar. 22, 2012

(30) Foreign Application Priority Data

Mar. 20, 2009 (DE) ..... 10 2009 013 684

(51) Int. Cl.
*F28D 1/04* (2006.01)
*F25B 39/00* (2006.01)
(Continued)

(52) U.S. Cl.
CPC ..... *F28D 1/0426* (2013.01); *F25B 39/00* (2013.01); *F28D 1/0443* (2013.01);
(Continued)

(58) Field of Classification Search
CPC .... F28D 1/0478; F28D 1/0426; F28D 1/0443; F28D 2021/007; F28D 2021/0071; F25B 39/00; F25B 39/026
(Continued)

(56) References Cited

U.S. PATENT DOCUMENTS 3,817,708 A 6/1974 Vernon
5,845,703 A 12/1998 Nir
(Continued)

FOREIGN PATENT DOCUMENTS

DE 1551523 A1 3/1970
DE 2343463 A1 3/1975
(Continued)

OTHER PUBLICATIONS

International Search Report, directed to PCT/DE2010/000309, dated Dec. 30, 2010, 6 pages.
(Continued)

*Primary Examiner* — Joseph F Trpisovsky
(74) *Attorney, Agent, or Firm* — Schmeiser, Olsen & Watts, LLP

(57) ABSTRACT

The invention relates to a heat exchanger unit having an evaporator device configured for evaporating a heat exchanger operating fluid, and a condenser device for condensing the heat exchanger operating fluid, wherein the evaporator device and the condenser device are fluidically connected to each other in a frontal configuration. The invention further relates to a thermotechnical system having a plurality of heat exchanger units.

7 Claims, 5 Drawing Sheets

Figure 1:
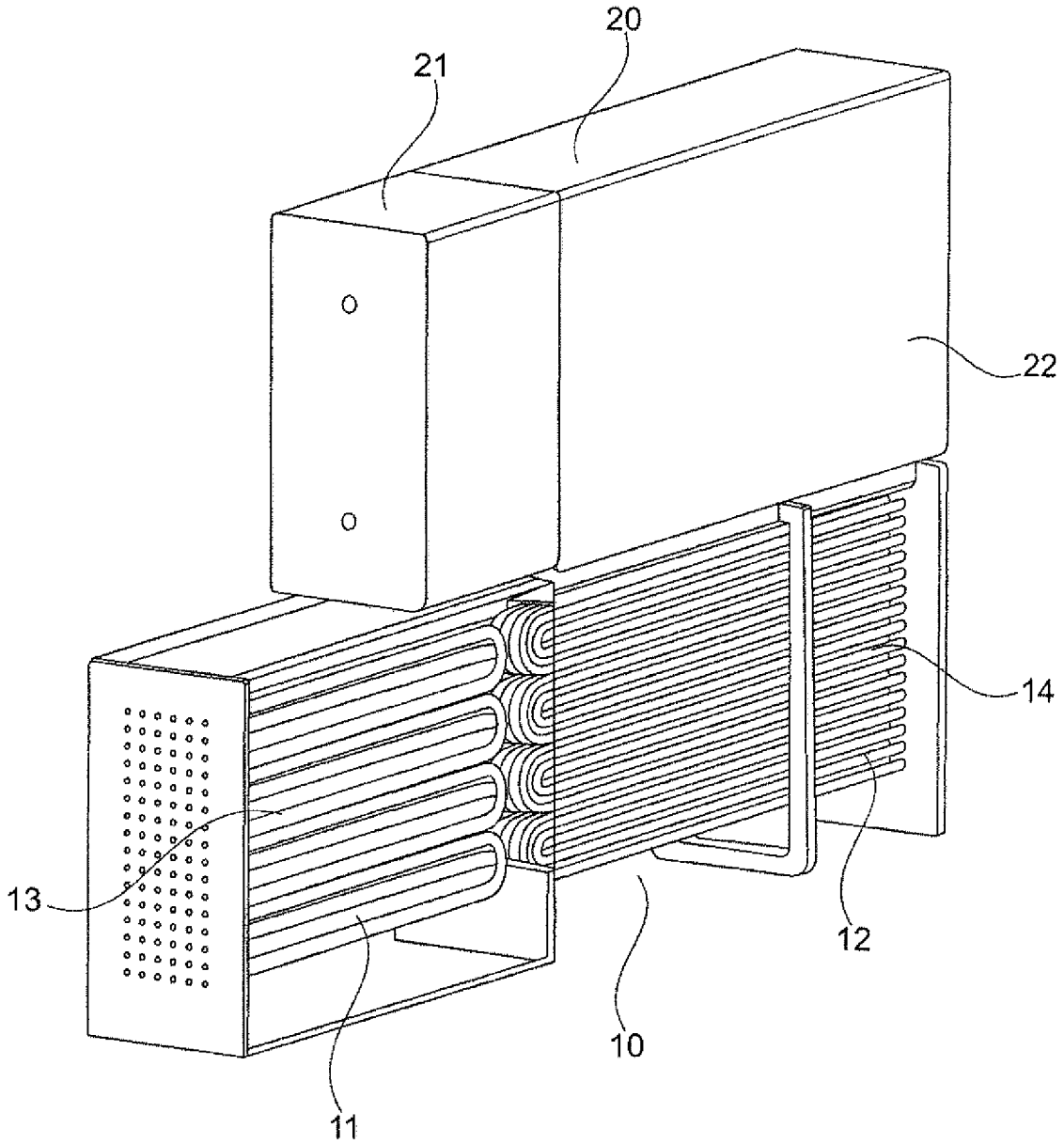

(51) Int. Cl.
*F28D 1/047* (2006.01)
*F28D 21/00* (2006.01)

(52) U.S. Cl.
CPC ..... *F28D 1/0478* (2013.01); *F28D 2021/007* (2013.01); *F28D 2021/0071* (2013.01)

(58) Field of Classification Search
USPC ..... 62/113, 513, 335, 333, 175, 6; 165/140, 165/165
See application file for complete search history.

(56) References Cited

U.S. PATENT DOCUMENTS

| | | | | |
|---|---|---|---|---|
| 5,916,251 | A * | 6/1999 | Sibik | 62/148 |
| 6,529,133 | B2 * | 3/2003 | Tamaoki et al. | 340/584 |
| 6,817,406 | B1 * | 11/2004 | Inoue | F28D 9/0043 165/115 |
| 2005/0061492 | A1 * | 3/2005 | Kurihara | B21D 53/085 165/150 |
| 2007/0084590 | A1 * | 4/2007 | Okumura et al. | 165/164 |
| 2007/0144186 | A1 * | 6/2007 | Shiflett et al. | 62/112 |
| 2009/0217680 | A1 * | 9/2009 | Petersen | F25B 43/046 62/85 |

FOREIGN PATENT DOCUMENTS

| | | | |
|---|---|---|---|
| DE | 19902695 | A1 | 7/1999 |
| DE | 19858686 | A1 | 6/2000 |
| EP | 1160530 | A1 | 12/2001 |
| GB | 951694 | A | 3/1964 |
| GB | 2451848 | A | 2/2009 |
| JP | 2000111212 | A | 4/2000 |
| WO | 2007006289 | A1 | 1/2007 |
| WO | 2007076602 | A1 | 7/2007 |

OTHER PUBLICATIONS

English translation of the International Preliminary Report on Patentability, directed to PCT/DE2010/000309, dated Oct. 20, 2011, 8 pages.

European Office Action for EP Application No. 10713231.2, dated Aug. 8, 2018.

* cited by examiner

HEAT EXCHANGER UNIT AND THERMOTECHNICAL SYSTEM

The invention relates to a heat exchanger unit and to a thermotechnical system, in particular a refrigeration system.

BACKGROUND OF THE INVENTION

The demand for air-conditioning, in particular cooling energy, and thus the total energy demand is constantly and significantly increasing due to increasing workplace requirements and desires for comfort. Air conditioning in automotive technology for the private or commercial sector with respect to the passenger compartment has increased within the last 10 years from a marginal market share and has reached nearly 100%. A similar development is to be expected for air-conditioning in existing buildings. In addition, with the implementation of the European directive on total energy efficiency of buildings, the cooling energy demand is considered in the future in the assessment of buildings. Thus, energy- and cost-efficient cooling technologies become more and more important.

An obstacle for the increased expansion of capital-intensive CHP technologies (combined heat and power) is the low system utilization during the summer months. Environmentally-friendly provision of refrigeration by means of thermal refrigeration processes is considered as a possibility to counteract said obstacle. Specifically in district heating networks which are primarily supplied by CHP systems, the necessary heating energy for operating thermal refrigeration processes is available as waste heat from the electricity generation.

The main components of refrigeration systems such as evaporators, absorbers, generators and condensers are heat exchangers which all transport the heat of media. These heat exchangers are responsible for 50% of the cost and 75% of the volume of the refrigeration system.

The document WO 2007/006289 A1 discloses the functional principle of a heat pump implemented as an absorption refrigerating system. The mode of operation of the heat pump which comprises a plurality of heat exchanger components is illustrated therein in detail by means of a schematic diagram. For the real construction of a system, the heat exchanger components are grouped together to form heat exchanger units which comprise an evaporator device configured for evaporating a heat exchanger operating fluid or heat exchanger work fluid and a condenser device configured for condensing the heat exchanger operating fluid or heat exchanger working fluid. Known designs or constructions for heat exchanger units provide a clear spatial separation of the functional units which, if applicable, are arranged in a common casing or common housing. In known heat exchanger units, the evaporator device and the condenser device are arranged side by side. One embodiment of such units is the so-called hamster cheek construction, wherein an evaporator device is arranged between two partial condenser devices and the entire structure is integrated in a tubular housing. Known units of heat exchanger components comprise a droplet separator or steam curtains to make the transition of liquid splashes to other heat exchanger units more difficult or to eliminate this completely.

SUMMARY OF THE INVENTION

It is an object of the invention to provide a heat exchanger unit with an improved constructional layout which supports the flexible use of heat exchanger units in applications with different requirements.

This object is achieved according to the invention by a heat exchanger unit according to the independent claim 1. Furthermore, a thermotechnical system, in particular refrigerating system according to the independent claim 10 is provided. Advantageous configurations of the invention are subject matter of dependent claims.

According to one aspect of the invention, a heat exchanger unit comprising an evaporator device configured for evaporating a heat exchanger operating fluid and a condenser device configured for condensing said heat exchanger operating fluid is provided, wherein the evaporator device and the condenser device are in fluid communication with each other so that heat exchanger operating fluid can flow and are arranged in a frontal configuration with respect to each other.

According to another aspect, a heat pump, in particular refrigerating system is provided which comprises a plurality of heat exchanger units which are assembled corresponding to a modular structure.

Up to now, heat exchangers of the known type were adapted individually and independently of each other to the required performance. The new unit provided by the invention consists of one or a plurality of pairs of evaporator devices and condenser devices which form a thermodynamic and process-related unit. This thermodynamic unit is in particular characterized in that the length of the vapor path as well as the specific vapor mass flow is independent of the absolute performance or capacity of the entire heat exchanger unit. Once optimized, the ratio of the capacities of the heat exchangers, which form a superordinated unit, among each other remains the same even in case of scalings of the performance.

It is possible to produce modular heat exchanger units which can be assembled to form a total system, whereby an improved scalability of thermotechnical systems or heat pumps, in particular refrigerating systems and desalination systems is possible. Moreover, the frontal configuration allows for a constructional layout with optimized utilization of space and contributes significantly to the thermal separation of different functional units, vapor generators and condensers, whereby thermal losses are minimized despite the spatial optimization.

The evaporator device can involve, for example, a generator or an evaporator. The condenser device, for example, is configured as an absorber or a condenser. Compared to known heat exchanger units, the frontal arrangement of evaporator devices and condenser devices results in a changed vapor flow behavior between the devices, which implies a kind of a wave formation, whereby an increased heat and mass transfer is achieved. The performance-related heat exchanger surface is reduced.

The scalability achieved with the invention enables to individually adapt thermotechnical systems, in particular refrigerating systems, in terms of system size and system performance for different applications. In particular, a compact design is possible so as to push forward into low capacity ranges which were unattractive for known designs of the possible assembly of heat exchanger components due to poor power density and excessive space requirements.

One preferred development of the invention provides that the evaporator device and the condenser device are arranged facing each other frontally. In this embodiment, the front faces of the evaporator device and the condenser device are arranged opposing each other either at a distance from each other or substantially lying on top of each other.

In an advantageous configuration of the invention it can be provided that the evaporator device and the condenser device are arranged such that their front sides mesh with each other at least in some sections. In this embodiment, line sections of the evaporator device and the condenser device mesh with each other in some sections, wherein an overlapping formed in this manner is preferably greater or smaller than half the longitudinal extension of the respective pipes.

An advantageous embodiment of the invention provides that pipes of the evaporator device and pipes of the condenser device mesh alternately with each other. One pipe of the evaporator device and one pipe of the condenser device are arranged in an alternating manner.

Preferably, a further embodiment of the invention provides that an evaporator device front face facing toward the condenser device is arranged substantially completely overlapping with a condenser device front face facing toward the evaporator device and/or vice versa. In one embodiment, the front faces are thus arranged substantially congruently.

One advantageous configuration of the invention provides for a droplet separator-free design. In contrast to known heat exchanger units, costs and provisions for a droplet separator can be saved.

One development of the invention provides for a vapor barrier-free and/or droplet barrier-free configuration. This results in a further simplification which facilitates a material- and cost-saving structure.

One preferred development of the invention provides for a modular structure. The provided construction principle with respect to arrangement of evaporator device and condenser device enables it in one embodiment to form independent flow characteristics for the heat exchanger operating fluid in the respective module, wherein said characteristics do not change even if a plurality of heat exchanger units structured as a module are assembled in one system.

In an advantageous configuration of the invention it can be provided that the evaporator device and the condenser device are formed in a thermal compressor. For example, the thermal compressor is integrated in a refrigerating system.

DESCRIPTION OF PREFERRED EXEMPLARY EMBODIMENTS OF THE INVENTION

The invention is explained in more detail hereinafter by means of preferred exemplary embodiments with reference to figures of a drawing. In the figures:

FIG. 1 shows a perspective illustration of a thermotechnical system comprising four heat exchanger components.

Figure 1A:
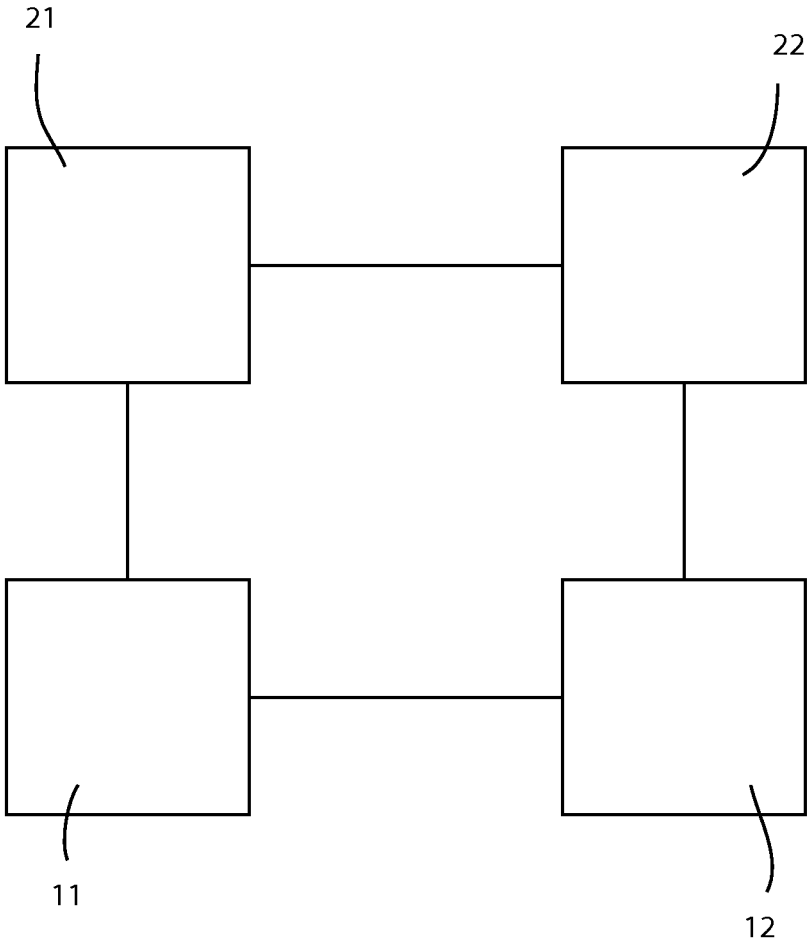
Figure 2:
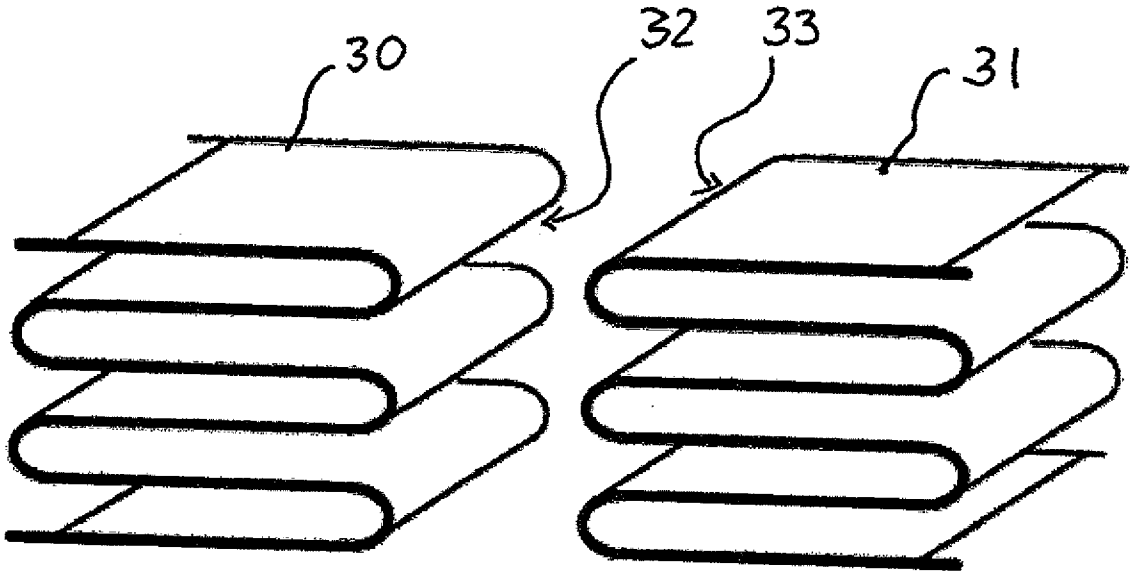
Figure 3:
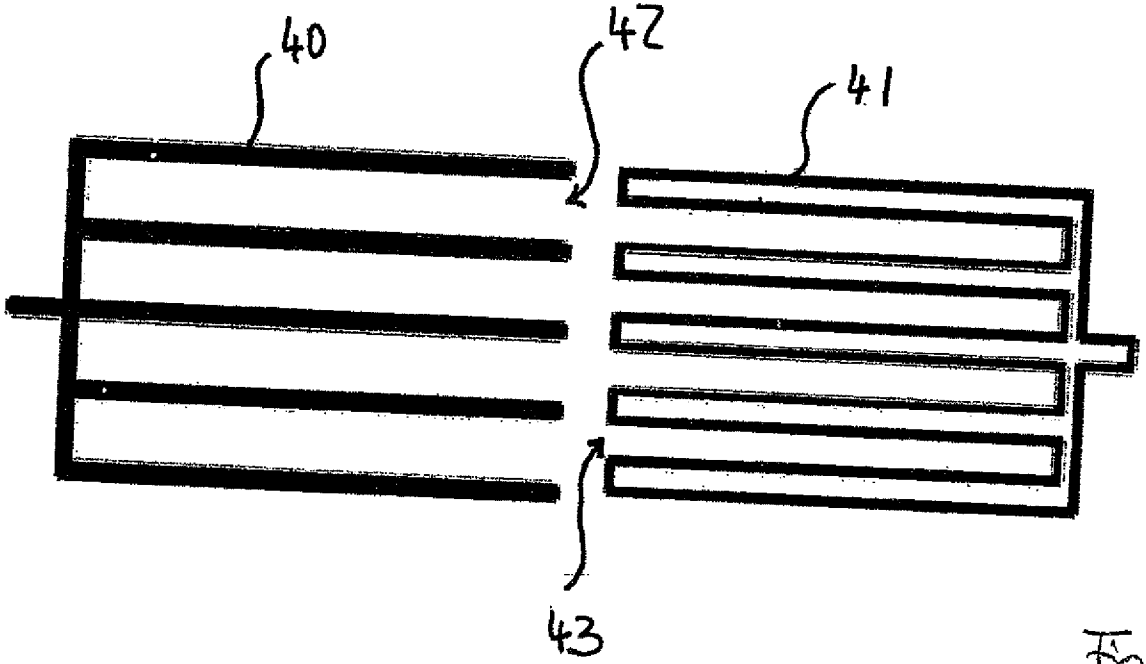
Figure 4:
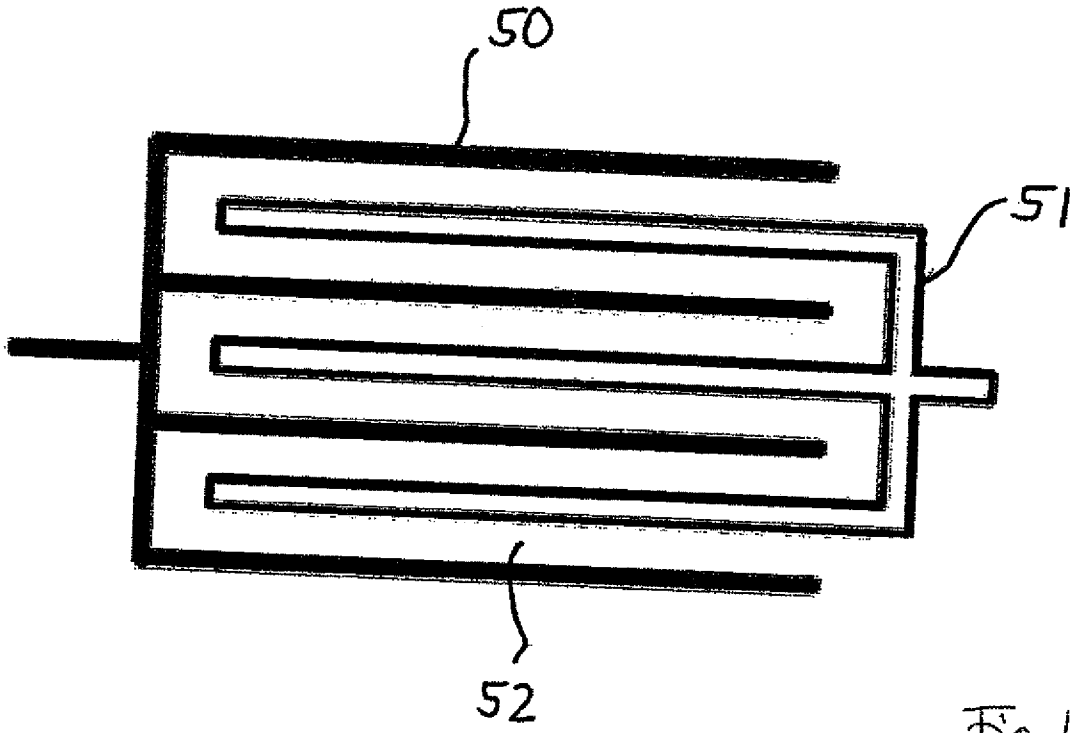

FIG. 1A depicts a schematic illustration of the fluid communication between the heat exchanger components, FIG. 2 shows a schematic illustration of a heat exchanger unit comprising a condenser device and an evaporator device, wherein the front faces are arranged opposing each other, FIG. 3 shows a schematic illustration of a heat exchanger unit comprising a condenser device and an evaporator device, wherein the front faces are likewise arranged opposing each other, and FIG. 4 shows a schematic illustration of a heat exchanger unit comprising a condenser device and an evaporator device in a frontal configuration, wherein the evaporator device and the condenser device are arranged partially meshing with each other.

FIG. 1 shows a perspective illustration of a thermotechnical system comprising a heat exchanger unit 10 which is formed with a vapor generator 11 and a condenser 12. The vapor generator 11 and the condenser 12 each have associated pipes 13, 14. On the heat exchanger unit 10, another heat exchanger unit 20 is arranged which is formed with a condenser 21 and a vapor generator 22. The two heat exchanger units 10, 20 form one refrigerating system.

The vapor generator 11 and the condenser 12 are positioned in a frontal configuration or arrangement, wherein the front faces are arranged opposing each other. The same constructional layout is provided for the further heat exchanger unit 20 comprising the condenser 21 and the evaporator 22.

Referring still to FIG. 1, and additional reference to FIG. 1A, during the operation of the refrigerating system, evaporated operating fluid, which is also designated as work fluid, flows from the vapor generator 11 to the condenser 12 in order to condensate there at least partially. The liquid condensate is then transferred to the vapor generator 22 in order to evaporate there and to subsequently flow as vapor to the condenser 21 where a condensation takes place again. The liquid generated here is then fed again to the vapor generator 11.

FIG. 2 shows a schematic illustration of a heat exchanger unit comprising a condenser device 30 and an evaporator device 31, wherein the front faces 32, 33 are arranged opposing each other.

FIG. 3 shows a schematic illustration of a heat exchanger unit comprising a condenser device 40 and an evaporator device 41, wherein the front faces 42, 43 are likewise arranged opposing each other.

FIG. 4 shows a schematic illustration of a heat exchanger unit comprising a condenser device 50 and an evaporator device 51 in a frontal configuration, wherein the evaporator device 50 and the condenser device 51 are arranged partially meshing with each other so that an overlapping region 52 is created.

The respective evaporator device (vapor generator) can involve an evaporator, a desorber or a generator. The respective condenser device (liquefier) is preferably configured as absorber or condenser.

The features of the invention disclosed in the above description, the claims and the drawing can be important individually as well as in any combination for the implementation of the invention in the different embodiments thereof.

The invention claimed is:

1. A thermotechnical system, comprising:

a plurality of heat exchanger units, wherein:

the plurality of heat exchanger units is in each case formed with an evaporator device configured for evaporating a heat exchanger operating fluid and a condenser device configured for condensing the heat exchanger operating fluid, wherein the evaporator device and the condenser device are in fluid communication with each other so that the heat exchanger operating fluid can flow from the evaporator device to the condenser device, wherein the evaporator device and the condenser device are arranged in a frontal configuration with respect to each other, such that a front side of the evaporator device and a front side of the condenser device oppose each other, the front side of the evaporator device being defined by a first plurality of pipes reversing direction, and the front side of the condenser being defined by a second plurality of pipes reversing direction and wherein the evaporator device and the condenser device are entirely separated from each other, and the plurality of heat exchanger units form a thermodynamic and process-related unit such that during operation:

evaporated heat exchanger operating fluid flows from the evaporator device of a first of the plurality of heat exchanger units to the condenser device of the first of the plurality of heat exchanger units in order to condense there at least partially forming a first liquid phase of the operating fluid, the first liquid phase of the operating fluid generated in the condenser device of the first of the plurality of heat exchanger units is then directly transferred to the evaporator device of a second of the plurality of heat exchanger units in order to evaporate there into vapor, and subsequently, the vapor generated in the evaporator device of the second of the plurality of heat exchanger units flows to the condenser device of the second of the plurality of heat exchanger units where a condensation takes place again and a second liquid phase of the operating fluid generated in this manner is fed again to the evaporator device of the first of the plurality of heat exchanger units;

wherein the frontal configuration and a spacing between the evaporator device and the condenser device of the first and the second plurality of heat exchanging units results in a wave formation of vapor that flows between the evaporator device and the condenser device during operation of the thermotechnical system;

wherein the spacing between the front side of the evaporator device and the front side of the condenser device of the first and second plurality of heat exchanger units is less than a length of the first plurality of pipes in a direction perpendicular to the front side of the evaporator device.

2. The thermotechnical system according to claim 1, wherein an evaporator front face facing toward the condenser device is arranged substantially completely overlapping with a condenser device front face facing toward the evaporator device.

3. The thermotechnical system according to claim 1, wherein each of the plurality of heat exchanger units has a droplet separator-free design.

4. The thermotechnical system according to claim 1, wherein each of the plurality of heat exchanger units has a vapor barrier-free and/or droplet barrier-free design.

5. The thermotechnical system according to claim 1, wherein the plurality of heat exchanger units are assembled in a modular structure.

6. The thermotechnical system, according to claim 1, wherein the plurality of heat exchanger units are assembled corresponding to a modular structure.

7. The thermotechnical system according to claim 1, wherein a condenser front face facing toward the evaporator device is arranged substantially completely overlapping with an evaporator device front face facing toward the condenser device.

* * * * *